US006592416B1

(12) United States Patent
Hochschild, III

(10) Patent No.: US 6,592,416 B1
(45) Date of Patent: Jul. 15, 2003

(54) TARGET FOR NAVAL GUNFIRE

(76) Inventor: Arthur A. Hochschild, III, 3322 Devon Cir., Huntington Beach, CA (US) 92649

( * ) Notice: Subject to any disclaimer, the term of this patent is extended or adjusted under 35 U.S.C. 154(b) by 0 days.

(21) Appl. No.: 10/114,971

(22) Filed: Apr. 2, 2002

(51) Int. Cl.[7] ..... B63B 22/20

(52) U.S. Cl. ..... 441/20; 441/6; 441/29; 441/30

(58) Field of Search ..... 441/1, 6, 20, 21, 441/22, 23, 28, 30, 37, 29; 114/24

(56) References Cited

U.S. PATENT DOCUMENTS 2,382,442 A * 8/1945 Rich et al. ..... 244/138 R
3,095,197 A * 6/1963 Weitzman ..... 273/350
3,500,408 A * 3/1970 Daughenbaugh ..... 342/10
3,613,097 A * 10/1971 Daughenbaugh ..... 342/10
4,155,132 A * 5/1979 Lee ..... 441/80
4,579,536 A * 4/1986 Cameron ..... 441/16

* cited by examiner

*Primary Examiner*—Sherman Basinger
(74) *Attorney, Agent, or Firm*—Donald D. Mon

(57) ABSTRACT

A floating target for naval gunfire. The target includes an inflatable buoyant superstructure with a drogue chute attached to the periphery of the bottom of the superstructure. The drogue chute, when in use is well underwater. The drogue chute is an open flexible structure with a bottom end weighted with ballast to deploy it, and with ports through its side to permit water to flow into and out of it. A line is attached to the bottom of the drogue chute to enable the target to be tipped and the drogue chute drained of water. A float can be attached to the free end of the line to facilitate recovery, or the line itself may be buoyant.

5 Claims, 1 Drawing Sheet

FIG. 1
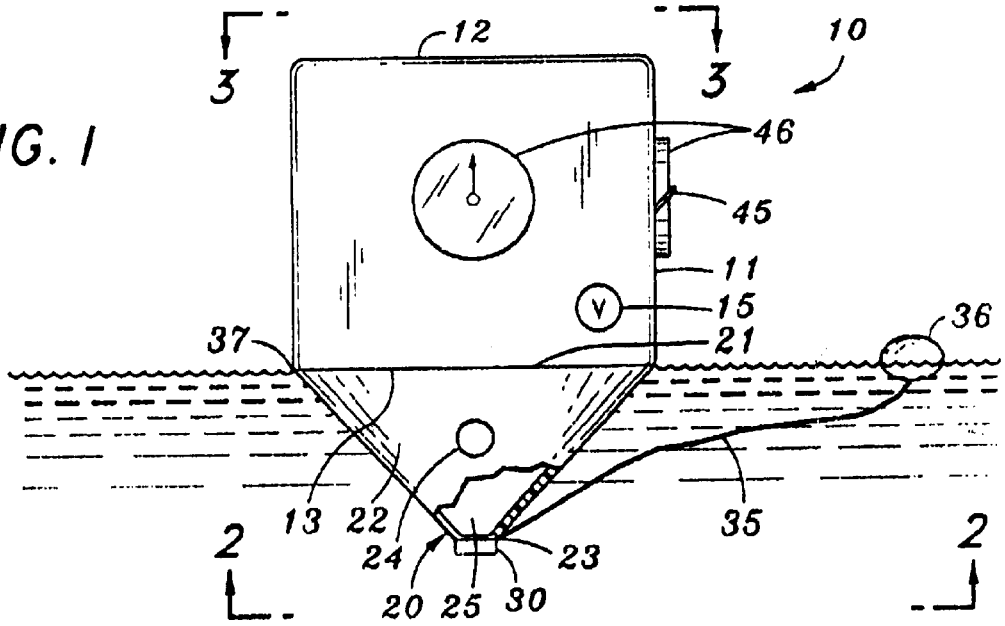
FIG. 2
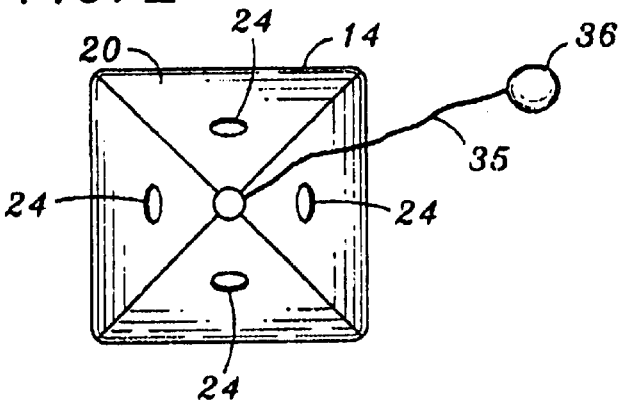
FIG. 3
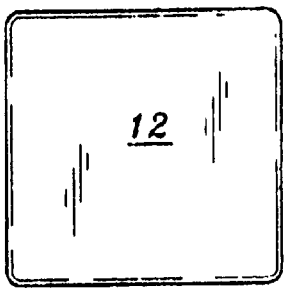
FIG. 5
FIG. 4
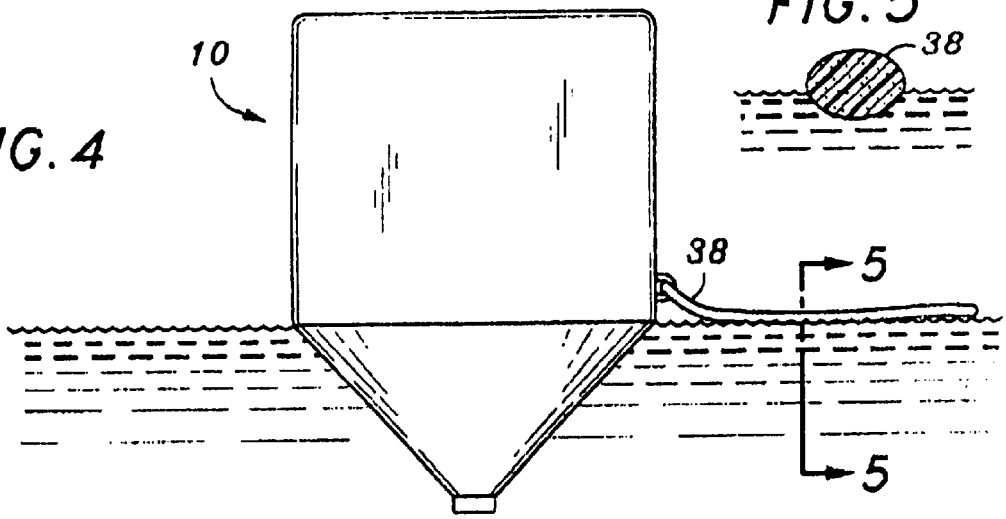

TARGET FOR NAVAL GUNFIRE

FIELD OF THE INVENTION

A buoyant, inflatable target for naval gunfire.

BACKGROUND OF THE INVENTION

As in all other types of gunnery, naval gunners require a target to shoot at not only to train them, but also to test their continuing skills. Naval warfare involves shipborne weapons and floating objects to be hit by gunfire. Training for these events inherently should involve a target that floats and moves in much the same manner as objects such as boats which would be an expected objective, and of the vessel carrying the weapon.

Here the problem is that in testing, one cannot provide a large number of "hard targets". There simply is not room for them in the inventory and they cost too much. Instead, it is common practice to provide buoyant inflatable and collapsible structures for targets. These can be made to a scale respective to a targeting problem. They can be folded to small size so that many can be stored, and can quickly be inflated to full size and launched onto the water.

It is an inherent shortcoming of these that they are susceptible not only to water currents and waves, but more particularly to the wind. Instead, such light weight, small mass targets tend to move around in a most independent manner, not properly simulative of the movements of a true targeted object. There have been previous attempts to reduce these adverse effects but they have proved to involve problems of their own. Known sea anchors of the parachute type tend to sink the target and resist its recovery. Attached drogue chutes tend to prevent the tilting movement needed for convenient recovery of the target.

It is an object of this invention to provide an inflatable floating target whose movements in the water are closely simulative of the movement of a body of substantial mass and stability so as to establish a truer test of the gunner's skills.

It is another object of this invention to provide an inflatable target that maintains a generally upright orientation. Previously-known inflatable targets have had the tendency to topple or roll over unless provided with excessive stiffening and ballasting. This invention provides its advantages in a generally flexible structure, overall, with minimal ballast.

In addition this invention provides means to enable the target conveniently to be tilted for recovery.

While integrated drogue chutes and sea anchors have been suggested for these purposes, they fail in several respects. As to known drogue chutes, they cannot be emptied to permit convenient recovery of the target. As to sea anchors, they can actually fall beneath the target, and hold the target so steadily that it can be destroyed by-strong waves, and can even sink it.

BRIEF DESCRIPTION OF THE INVENTION

The invention includes an inflatable impermeable membrane superstructure formed to a shape useful for a target. Usually this will have a square or a rectangular horizontal section, although curved or complex structures could be provided instead. The superstructure includes a top, a bottom, and a side wall connecting them to form a fluid tight structure.

A drogue chute has an upper edge attached to the bottom of the superstructure, and a side wall departing from said upper edge and terminating at a lower end, preferably having a decreasing horizontal cross-section as it approaches its lower end. The side walls have ports to permit a limited flow of water from the outside of the drogue chute into and through the internal chamber of the drogue chute.

As a feature of this invention, the lower end of the drogue chute is weighted by a ballast weight so as to draw the drogue chute structure toward its deployed condition, and a flexible line is fastened at one of its ends to the drogue chute, preferably at or near its lower end. A float is attached to the other end of the line so it will be accessible when the target is to be recovered.

As an optional feature, a floatable rope may be secured above the waterline for ease of retrieval. With such a rope, a separate float will not be necessary. The rope itself will be atop the water for retrieval.

The above and other features of this invention will be fully understood from the following detailed description and the accompanying drawings, in which:

BRIEF DESCRIPTION OF THE DRAWINGS

FIG. 1 is a front elevation partly in cutaway cross-section of the preferred embodiment of the invention in its deployed configuration. The side and rear elevation are identical;

FIG. 2 is a bottom view taken at line 2—2 in FIG. 1;

FIG. 3 is a top view taken at line 3—3 in FIG. 1;

FIG. 4 is a side elevation showing another embodiment of the invention; and

FIG. 5 is a cross-section taken at line 5—5 in FIG. 4.

DETAILED DESCRIPTION OF THE INVENTION

A target 10 according to the invention is shown in FIG. 1. It is made from flexible membrane material so it can be collapsed and folded to a small bulk, and part of it can be inflated for a target. The material is, of course, impermeable to the inflating gas, which may be air, oxygen, carbon dioxide, or any other gas which is compatible with the material. Polyvinyl chloride or polyethylene sheeting is useful. These are attractive because structural seams can be heat sealed, solvent sealed, or cemented as desired.

The superstructure 11 of this target includes a top 12, a bottom 13 and a sidewall 14. The sidewall may be of any desired shape. For most purposes it will have a rectangular horizontal cross-section as shown. Instead it could be rectangular, circular, or of any desired useful shape.

A valve 15 in one of the side walls will be provided to enable the superstructure to be inflated or deflated as appropriate.

A drogue chute 20 is attached to bottom 13 of the superstructure. Its upper edge 21 preferably conforms to the perimeter of the sidewall and bottom of the superstructure. It comprises a flexible structure formed from material identical to or similar to that of the superstructure. It can be folded for storage, and unfolded when the target is deployed.

The deployed drogue chute is preferably tapered, with a sidewall 22 converging toward a lower end 23. A convenient shape is pyramidal, although any tapered shape will also do, for example, conical. A plurality of ports 24 are formed in the sidewall. They are large enough to permit some flow of water into and out of chamber 25 in the drogue chute, but small enough to leave a sufficient area of material to engage the current of water that flows against the chute. The chamber 25 is defined by the shape of the deployed chute.

Thus, this drogue chute acts as an anchor both against drift caused by wind on the superstructure and an enablement for some of the current to pass through the drogue chute with reduced current force on the target.

A ballast weight 30 is fixed to the bottom end of the drogue chute. When the superstructure is inflated, the weight will pull the drogue chute down to the illustrated shape. In the water, the chute will quickly fill, and will stabilize the target so it stands upright in the water, and will resist movement of the target by the wind.

Previous to this invention, typical sea anchors were often used. A sea anchor is a parachute-like structure submerged in the water and connected by a line to the target. It is resistive to movement of the target, being pulled as a drag through the water by wind forces exerted on the target. A pervasive problem is that the sea anchor can drop downwardly, and become a deadweight on the target, which might submerge the target, and which will resist recovery of the target.

This invention overcomes such prior difficulties by providing a flexible line 35 attached to the bottom end of the drogue chute to pull the bottom upward, tilting the target, and spilling the water that was in the drogue chute when the target is to be removed. The superstructure can then be vented by opening the valve, and the fully collapsed target can readily be pulled aboard.

A float 36 is attached to the other end of the line. Because it is floating in the water, it can readily be accessed, and the line can the be pulled to start the process of recovering the target. The water line is shown at 37.

Instead of a line that tends to sink, and a float to access its end, a floatable line 38 (FIG. 4) can be used. This line will be attached to the target above the water line, and will float around on the surface of the water, where it can readily be accessed. An advantage of a floating rope is that it keeps out of the propeller of the boat that is retrieving the target.

Thus, this target provides a stable structure in wind and water that can readily be recovered merely by pulling on the freely floating end of a flexible line to tilt the superstructure and drain the drogue chute, and then venting the superstructure by opening its valve.

The superstructure can be provided with appliques of material reflective of electromagnetic energy such as light and radar. Metallic foils are an example. The superstructure itself, appliques, or portions of the superstructure can be colored for better visibility. International orange is a preferred color for this purpose.

A typical size is a 10 foot cube for the superstructure, 3 foot height for the drogue chute, with four 6 inch ports.

Attachment points 45 of any desired type may be placed on the top and/or sides of the target. These enable the ready attachment of radar reflection devices 46 which often comprise structures such as cube corners. They are shown only schematically in FIG. 1, and are optional. These may be attached while the target is on the deck and inflated. After they are attached, the target is thrown overboard. At recovery time, they can be detached for later use.

This invention is not to be limited by the embodiment shown in the drawings and described in the description, which is given by way of example and not of limitation, but only in accordance with the scope of the appended claims.

I claim:

1. A buoyant target for gunfire comprising:

a superstructure having a top, a bottom and a peripheral sidewall made of flexible gas impermeable material joined together with a valve that permits injection and withdrawal of gas into and from the superstructure;

a drogue chute having an upper edge attached to said bottom of said superstructure, said drogue chute being flexible and sheet-like, having a plurality of ports therethrough, and extending to a narrowed lower end;

a ballast weight mounted to said lower end;

a flexible line having one of its ends attached to said drogue chute at a first location spaced from said upper edge, said line having a substantial length, and a float on said line at a location thereon sufficiently spaced from said first location as to enable the line conveniently to be grasped;

whereby, when the superstructure is inflated and resting atop of a body of water with the drogue chute filled, said float can be accessed, said line may be grasped and pulled to tip the superstructure and spill water from the drogue chute, and the superstructure can be approached and deflated for storage.

2. A buoyant target according to claim 1 in which said first end of said line is attached to said lower end of said drogue chute.

3. A target according to claim 2 in which said drogue chute when deployed is tapered, and said superstructure is substantially cubical.

4. A target according to claim 1 in which said sidewall includes a plurality of planar sides when the superstructure is inflated, and material reflective of electromagnetic energy is applied to at least one of said sides.

5. A target according to claim 1 in which said sidewall includes at least one attachment point for attachment of a radar reflective device.

* * * * *